US009897948B2

(12) United States Patent
Hayami

(10) Patent No.: US 9,897,948 B2
(45) Date of Patent: Feb. 20, 2018

(54) TRANSFER DEVICE, IMAGE FORMING APPARATUS AND RECORDING MEDIUM

(71) Applicant: Konica Minolta, Inc., Chiyoda-ku, Tokyo (JP)

(72) Inventor: Toshiki Hayami, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/265,790

(22) Filed: Sep. 14, 2016

(65) Prior Publication Data

US 2017/0090359 A1 Mar. 30, 2017

(30) Foreign Application Priority Data

Sep. 28, 2015 (JP) ..... 2015-189477

(51) Int. Cl.
*G03G 15/16* (2006.01)

(52) U.S. Cl.
CPC ..... *G03G 15/1675* (2013.01); *G03G 15/1605* (2013.01)

(58) Field of Classification Search
CPC ..... G03G 15/1665; G03G 15/1675
See application file for complete search history.

(56) References Cited

U.S. PATENT DOCUMENTS 8,626,011 B2 * 1/2014 Yamada ..... G03G 15/161 399/44
2013/0121714 A1 * 5/2013 Tanaka ..... G03G 15/1675 399/66

FOREIGN PATENT DOCUMENTS

| | | |
|---|---|---|
| JP | 03-132684 | 6/1991 |
| JP | 2006-267486 | 10/2006 |
| JP | 2011-013241 | 1/2011 |
| JP | 2012-042832 | 3/2012 |
| JP | 2012-198500 | 10/2012 |

OTHER PUBLICATIONS

Notice of Reasons for Rejection issued Sep. 26, 2017, in Japanese Patent Application No. 2015-189477, 7 pages.
Notice of Reasons for Rejection dated Jan. 9, 2018 in Japanese Patent Application No. 2015-189477, with English Translation, 10 pages total.

* cited by examiner

*Primary Examiner* — Erika J Villaluna
(74) *Attorney, Agent, or Firm* — Squire Patton Boggs (US)

(57) ABSTRACT

A transfer device includes a voltage applying section configured to apply a transfer bias to a transfer member, and a control section configured to control the voltage applying section to apply a transfer bias in which a first application period for applying a first transfer bias and a second application period for applying a second transfer bias are alternately provided to the transfer member when a first sheet having a small surface smoothness passes through a nip.

20 Claims, 7 Drawing Sheets

TRANSFER DEVICE, IMAGE FORMING APPARATUS AND RECORDING MEDIUM

CROSS REFERENCE TO RELATED APPLICATIONS

This application is entitled to and claims the benefit of Japanese Patent Application No. 2015-189477, filed on Sep. 28, 2015, the disclosure of which including the specification, drawings and abstract is incorporated herein by reference in its entirety.

BACKGROUND OF THE INVENTION

1. Field of the Invention

The present invention relates to a transfer device, an image forming apparatus and a recording medium.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to a photoconductor drum (image carrier) on which the electrostatic latent image is formed, whereby a toner image is formed. Further, the toner image is directly or indirectly transferred to a sheet, and then heat and pressure are applied to the sheet at a fixing nip to form a toner image on the sheet.

As a transfer device used in the above-mentioned image forming apparatus, a transfer device including a first transfer member (for example, intermediate transfer belt) which bears a toner image and a second transfer member (for example, secondary transfer roller) which forms a transfer nip with the first transfer member is known. Normally, a transfer bias composed of a DC voltage having a constant value is applied to the second transfer member, and a transfer electric field is formed between the first transfer member and the second transfer member. With the transfer electric field formed in the above-mentioned manner, the toner image on the first transfer member is electrostatically moves to the sheet, and the toner image is transferred to the sheet. For the transfer devices of the above-mentioned type, various techniques for improving the efficiency of transfer of a toner image to a sheet have been proposed.

For example, Japanese Patent Application Laid-Open No. 3-132684 discloses a configuration in which a transfer bias composed of pulse waves including a first part and a second part is applied to a second transfer member, the first part corresponding to a first DC voltage capable of transferring a toner image to a sheet passing through a transfer nip, the second part corresponding to a second DC voltage which is smaller than the first DC voltage in absolute value and has the polarity as that of the first DC voltage.

In addition, Japanese Patent Application Laid-Open No. 2012-42832 discloses a configuration in which a transfer bias composed of pulse waves having alternating current components in which a transfer voltage and a returning voltage having different polarities are alternately repeated is applied to the second transfer member. In this configuration, in a recess of a sheet having a small surface smoothness, that is, a sheet having a surface having a large irregularity such as embossed paper, reciprocation of toner between the first transfer member and the sheet is caused with the transfer voltage and the returning voltage for the purpose of improving the transfer.

Incidentally, a space is formed between the recess on a surface of a sheet having a large irregularity and the first transfer member, and therefore, for example, when transfer is performed using the transfer bias composed of the first DC voltage as disclosed in Japanese Patent Application Laid-Open No. 3-132684, the transfer electric field formed in the recess is insufficient to move the toner to bottom of the recess due to the space. When toner is transferred with such a transfer electric field, the toner does not easily move to the bottom of the recess, and consequently transfer defect is caused at the recess of the sheet.

In addition, it is conceivable to increase the value of the transfer bias in order to form electric field enough to move the toner in the recess. However, when a transfer bias having an increased voltage value is kept applied to the second transfer member, electrostatic discharge is easily caused in the recess, and in addition, reverse charging of the toner due to the excessive current is caused at the portions other than the recess. Consequently, transfer defect is caused.

It is to be noted that, in the configuration disclosed in Japanese Patent Application Laid-Open No. 2012-42832, the transfer voltage and the returning voltage have different polarities, and therefore the change width between the transfer voltage and the returning voltage is large. Consequently, noise of undershooting of the voltage at falling of the pulse wave and noise of overshooting of the voltage at rising of the pulse wave have a large influence, and in turn, transfer defect is caused.

SUMMARY OF THE INVENTION

An object of the present invention is to provide a transfer device, an image forming apparatus and a recording medium which can reduce transfer defect in the case where a sheet having a surface having a large irregularity is used.

To achieve the abovementioned object, a transfer device reflecting one aspect of the present invention includes: an image bearing member on which to bear a toner image; a transfer member used for forming a transfer nip at the image bearing member; a voltage applying section configured to apply to the transfer member a transfer bias of one polarity for transferring a toner image on the image bearing member to a sheet passing through the transfer nip; and a control section configured to control the voltage applying section to apply the transfer bias to the transfer member when a first sheet having a small surface smoothness passes through the transfer nip, the transfer bias including a first application period for applying a first transfer bias greater than a reference transfer bias in absolute value and a second application period for applying a second transfer bias equal to or smaller than the reference transfer bias in absolute value, the first application period and the second application period being alternately provided, the reference transfer bias being set as a transfer bias to be applied when a second sheet different from the first sheet passes through the transfer nip.

Desirably, in the transfer device, a period during which all positions on the first sheet pass through the transfer nip includes the first application period and the second application period.

Desirably, in the transfer device, the second transfer bias is smaller than the reference transfer bias in absolute value.

Desirably, in the transfer device, a time integration value of a difference between the reference transfer bias and the first transfer bias is equal to a time integration value of a difference between the reference transfer bias and the second transfer bias.

Desirably, in the transfer device, the voltage applying section includes a direct current power source configured to apply and switch the first transfer bias and the second transfer bias.

Desirably, in the transfer device, the voltage applying section includes: a first direct current power source configured to apply the first transfer bias; and a second direct current power source configured to apply the second transfer bias.

Desirably, in the transfer device, in the transfer bias, the number of the first application periods and the second application periods is eight or ten.

An image forming apparatus reflecting one aspect of the present invention includes: an image bearing member on which to bear a toner image; a transfer member used for forming a transfer nip at the image bearing member; a voltage applying section configured to apply to the transfer member a transfer bias of one polarity for transferring a toner image on the image bearing member to a sheet passing through the transfer nip; and a control section configured to control the voltage applying section to apply the transfer bias to the transfer member when a first sheet having a small surface smoothness passes through the transfer nip, the transfer bias including a first application period for applying a first transfer bias greater than a reference transfer bias in absolute value and a second application period for applying a second transfer bias equal to or smaller than the reference transfer bias in absolute value, the first application period and the second application period being alternately provided, the reference transfer bias being set as a transfer bias to be applied when a second sheet different from the first sheet passes through the transfer nip.

Desirably, in the image forming apparatus, a period during which all positions on the first sheet pass through the transfer nip includes the first application period and the second application period.

Desirably, in the image forming apparatus, the second transfer bias is smaller than the reference transfer bias in absolute value.

Desirably, in the image forming apparatus, a time integration value of a difference between the reference transfer bias and the first transfer bias is equal to a time integration value of a difference between the reference transfer bias and the second transfer bias.

Desirably, in the image forming apparatus, the voltage applying section includes a direct current power source configured to apply and switch the first transfer bias and the second transfer bias.

Desirably, in the image forming apparatus, the voltage applying section includes: a first direct current power source configured to apply the first transfer bias; and a second direct current power source configured to apply the second transfer bias.

Desirably, in the image forming apparatus, in the transfer bias, the number of the first application periods and the second application periods is eight or ten.

To achieve the abovementioned object, in a computer-readable recording medium which storing a program of a transfer device reflecting one aspect of the present invention, the transfer device includes: an image bearing member on which to bear a toner image; a transfer member used for forming a transfer nip at the image bearing member; and a voltage applying section configured to apply to the transfer member a transfer bias of one polarity for transferring a toner image on the image bearing member to a sheet passing through the transfer nip. The program causes a computer of the transfer device to execute a process of controlling the voltage applying section to apply the transfer bias to the transfer member when a first sheet having a small surface smoothness passes through the transfer nip, the transfer bias including a first application period for applying a first transfer bias greater than a reference transfer bias in absolute value and a second application period for applying a second transfer bias equal to or smaller than the reference transfer bias in absolute value, the first application period and the second application period being alternately provided, the reference transfer bias being set as a transfer bias to be applied when a second sheet different from the first sheet passes through the transfer nip.

Desirably, in the recording medium, a period during which all positions on the first sheet pass through the transfer nip includes the first application period and the second application period.

Desirably, in the recording medium, the second transfer bias is smaller than the reference transfer bias in absolute value.

Desirably, in the recording medium, a time integration value of a difference between the reference transfer bias and the first transfer bias is equal to a time integration value of a difference between the reference transfer bias and the second transfer bias.

Desirably, in the recording medium, the voltage applying section includes a direct current power source configured to apply and switch the first transfer bias and the second transfer bias.

Desirably, in the recording medium, the voltage applying section includes: a first direct current power source configured to apply the first transfer bias; and a second direct current power source configured to apply the second transfer bias.

DESCRIPTION OF THE PREFERRED EMBODIMENTS

Figure 1:
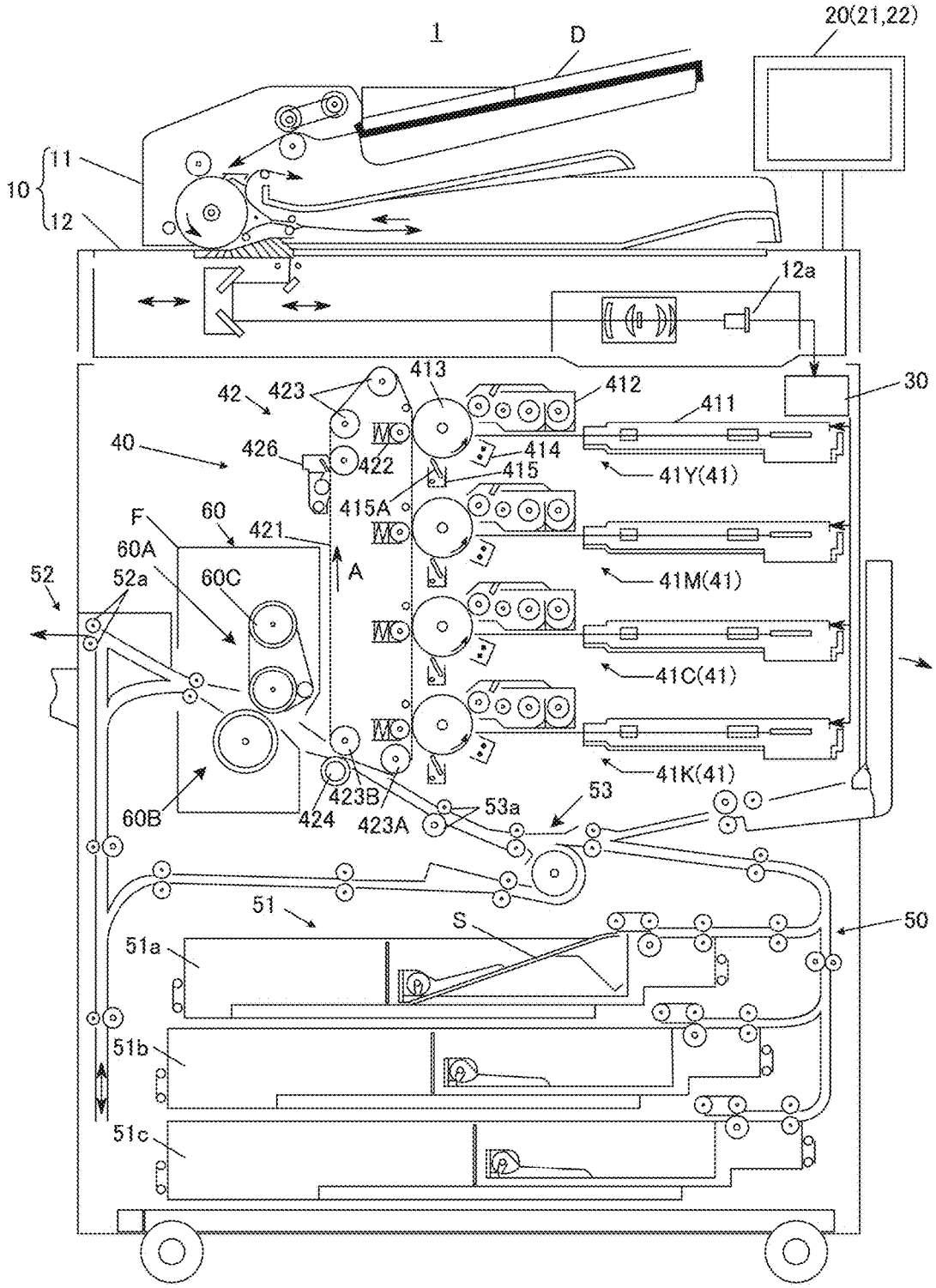
FIG. 1 schematically illustrates a general configuration of an image forming apparatus according to an embodiment.
Figure 2:
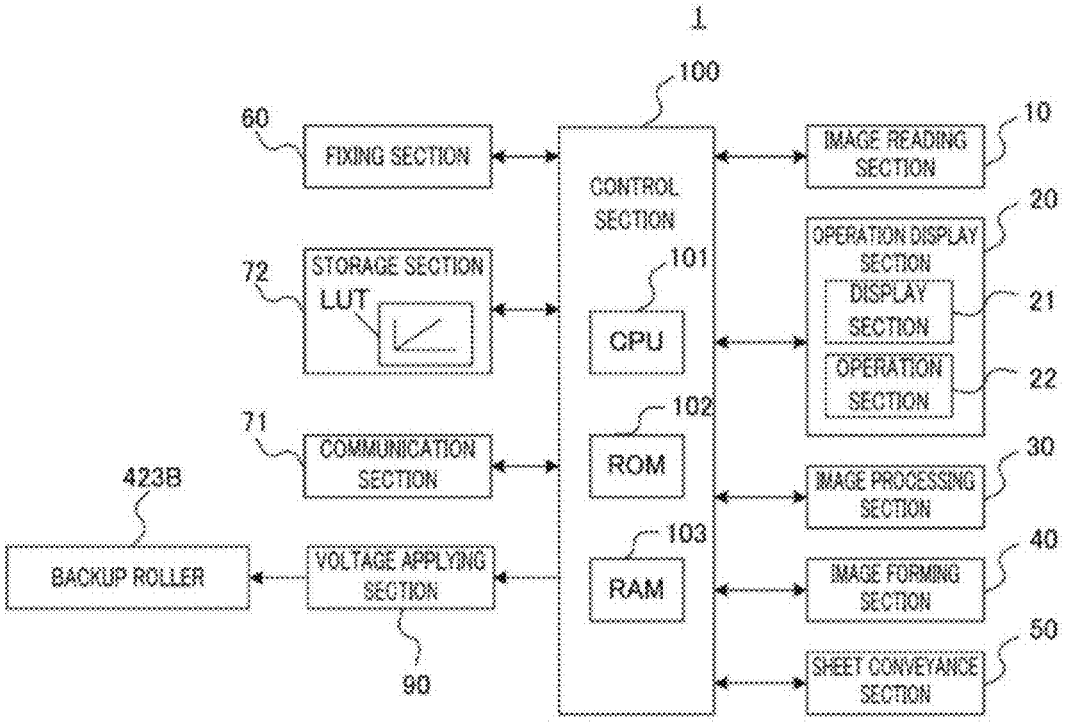
FIG. 2 illustrates a principal part of a control system of the image forming apparatus according to the embodiment.

In the following, the present embodiment is described in detail with reference to the drawings. FIG. 1 illustrates an overall configuration of image forming apparatus 1 according to the present embodiment. FIG. 2 illustrates a principal part of a control system of image forming apparatus 1 according to the embodiment. Image forming apparatus 1 illustrated in FIGS. 1 and 2 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 secondary-transfers the resultant image to a sheet, thereby forming an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60, voltage applying section 90 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive. In the present embodiment, storage section 72 stores image formation information relating to a printing job executed by image forming section 40.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

As illustrated in FIG. 1, image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

As illustrated in FIG. 2, operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

As illustrated in FIG. 1, image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like.

Photoconductor drum 413 is composed of an organic photoconductor in which a photosensitive layer made of a resin containing an organic photoconductive member is formed on the outer peripheral surface of a drum-like metal base, for example. Examples of the resin of the photosensitive layer include polycarbonate resin, silicone resin, polystyrene resin, acrylic resin, methacryl resin, epoxy resin, polyurethane resin, chloride vinyl resin, melamine resin and the like.

Control section 100 controls a driving current supplied to a driving motor (not shown in the drawings) that rotates photoconductor drums 413, whereby photoconductor drums 413 is rotated at a constant circumferential speed.

Charging device 414 is, for example, a charging charger and causes corona discharge to evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. As a result, in the surface of photoconductor drum 413, an electrostatic latent image of each color component is formed in the image region irradiated with laser light by the potential difference from the background region.

Developing device 412 is a developing device of a two-component reverse type, and attaches developers of respective color components to the surface of photoconductor drums 413, and visualizes the electrostatic latent image to form a toner image.

For example, a direct current developing bias having a polarity same as the charging polarity of charging apparatus 414, or a developing bias in which a direct current voltage having a polarity same as the charging polarity of charging apparatus 414 is superimposed on an alternating current voltage is applied to developing device 412 Thus, reversal development for attaching toner to an electrostatic latent image formed by exposing device 411 is performed.

Drum cleaning device 415 includes plate-shaped drum cleaning blade 415A composed of an elastic body configured to be brought into contact with the surface of photoconductor drum 413, and the like, and removes residual toner that remains on the surface of photoconductor drum 413 without being transferred to intermediate transfer belt 421 after the primary transfer.

Intermediate transfer unit 42 includes intermediate transfer belt 421, primary transfer roller 422, a plurality of support rollers 423, secondary transfer roller 424, belt cleaning device 426 and the like. Intermediate transfer belt 421 corresponds to "image bearing member" of the embodiment of the present invention, and intermediate transfer unit 42, voltage applying section 90 and control section 100 correspond to "transfer device" of the embodiment of the present invention.

Intermediate transfer unit 42 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer nip can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed. Backup roller 423B corresponds to "transfer member" of the embodiment of the present invention, and the secondary transfer nip corresponds to "transfer nip" of the embodiment of the present invention.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side, that is, a side of intermediate transfer belt 421 that makes contact with primary transfer rollers 422 whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to backup roller 423B, and electric charge having the same polarity as that of the toner is given to the front surface side of sheet S, that is, the side which makes contact with intermediate transfer belt 421, whereby the toner image is electrostatically transferred to sheet S, and sheet S is conveyed toward fixing section 60.

The secondary transfer bias is generated by voltage applying section 90 under the control of control section 100, and is applied from voltage applying section 90 to backup roller 423B. The secondary transfer bias will be described later. The secondary transfer bias corresponds to "transfer bias" of the embodiment of the present invention.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface side, that is, a side of the surface on which a toner image is formed, of sheet S, lower fixing section 60B having a back side supporting member disposed on the rear surface side, that is, a side of the surface opposite to the fixing surface, of sheet S, heating source 60C, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of conveyance rollers such as registration roller body 53*a*.

Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Figure 3:
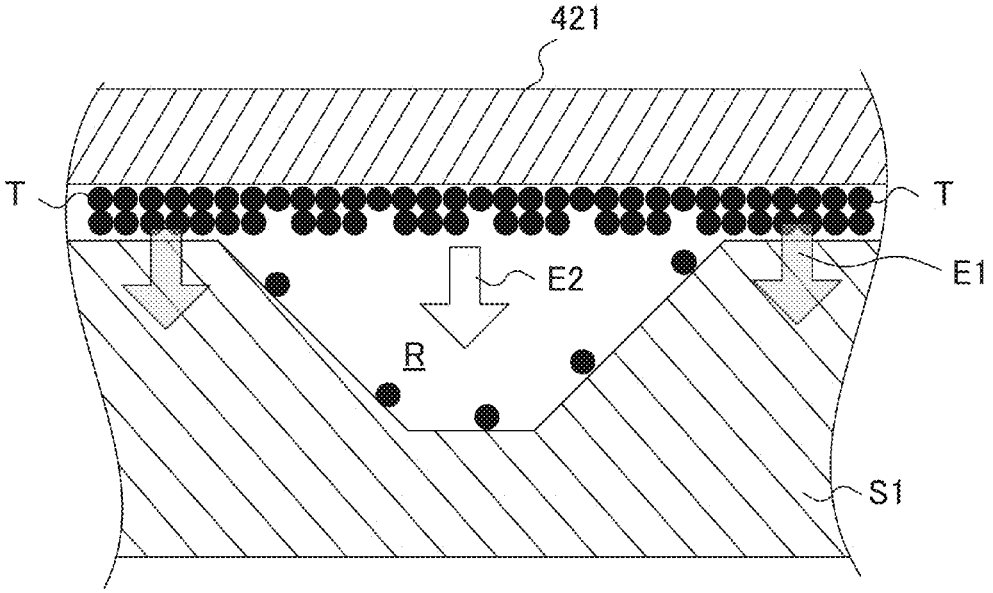
FIG. 3 illustrates a state where toner is transferred with a reference transfer bias in a recess of a sheet.

Incidentally, as illustrated in FIG. 3, in the case where sheet S1, such as embossed paper, having a surface shape having a small surface smoothness, that is, a large irregularity is printed, a space is formed between intermediate transfer belt 421 and recess R of sheet S1. Sheet S1 corresponds to "first sheet" of the embodiment of the present invention.

Normally, a secondary transfer bias which can transfer a toner image to a sheet having a small irregularity, that is, a second sheet different from sheet S1 is applied to backup roller 423B, and therefore electric field E1 enough to move toner T to sheet S1 is formed at portions other than recess R in sheet S1.

However, because of the space, electric field E2 formed at recess R of sheet S1 is not enough to move toner T from intermediate transfer belt 421 to sheet S1. Therefore, toner T does not easily move to the bottom of recess R, and transfer defect occurs at recess R of sheet S1.

Figure 4:
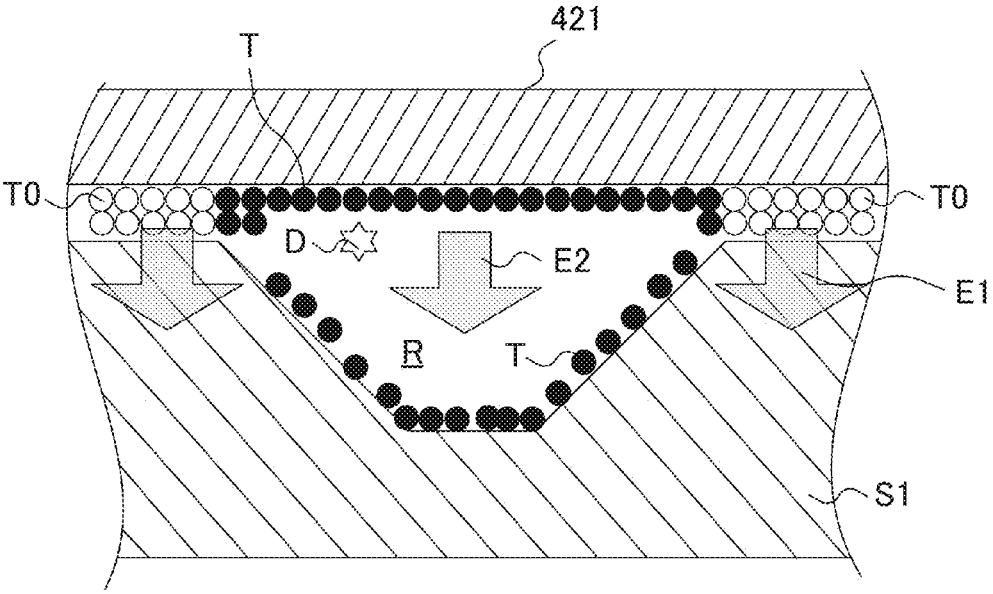
FIG. 4 illustrates a state where toner is transferred with a transfer voltage greater than a reference transfer bias in a recess of a sheet.

To reduce such transfer defect, it is conceivable to take an approach of increasing the secondary transfer bias to form large electric field E2 enough to move toner T to sheet S1 at recess R of sheet S1 as illustrated in FIG. 4. However, when a state where the secondary transfer bias is increased, that is, a state where electric field E2 is increased, is maintained, electrostatic discharge D is generated in the space between intermediate transfer belt 421 and sheet S1 at recess R of sheet S1.

In addition, when the secondary transfer bias is increased, electric field E1 at portions other than recess R in sheet S1 is also increased, and consequently toner T0 of that portion is reversely charged due to the excessive current.

In view of this, in the present embodiment, voltage applying section 90 applies secondary transfer bias W to backup roller 423B. In secondary transfer bias W, first application period W1 for applying first transfer bias V1 and second application period W2 for applying second transfer bias V2 are alternately provided as illustrated in FIG. 5.

First transfer bias V1 is greater than reference transfer bias Vt in absolute value. Reference transfer bias Vt is set as a transfer bias to be applied when a second sheet other than sheet S1 passes through the secondary transfer nip. Second transfer bias V2 is a voltage having the same polarity as that of first transfer bias V1, and is smaller than first transfer bias V1 in absolute value. The period during which all positions of sheet S1 pass through the secondary transfer nip, that is, one cycle of the secondary transfer bias W, includes one first application period W1 and one second application period W2.

Figure 5:
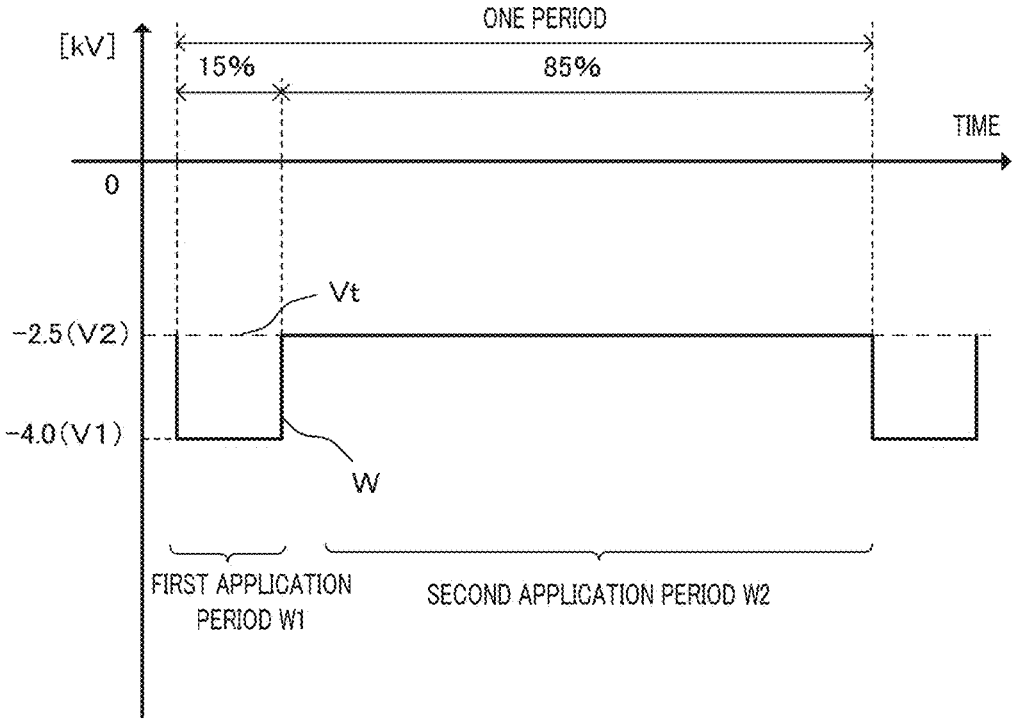
FIG. 5 shows a first example of such a secondary transfer bias.

In FIG. 5, first transfer bias V1 is set to −4.0 [kV], second transfer bias V2 and reference transfer bias Vt to −2.5 [kV], the duty ratio of the part corresponding to first application period W1 of secondary transfer bias W to 15[%], and the frequency of secondary transfer bias W to 500 [Hz].

When secondary transfer bias W having the above mentioned setting is applied to backup roller 423B, an electric field enough to move toner T to the bottom of recess R of sheet S1 is generated with first transfer bias V1 which momentarily has a value greater than that of reference transfer bias Vt in one cycle of secondary transfer bias W. With this configuration, transfer defect at recess R of sheet S1 can be reduced.

In addition, during second application period W2 after first application period W1, second transfer bias V2 equal to reference transfer bias Vt is applied to backup roller 423B, and thus secondary transfer bias W is not kept at first transfer bias V1 greater than reference transfer bias Vt. Accordingly, generation of electrostatic discharge in the space of recess R of sheet S1 can be reduced, and reverse charging of toner T at portions other than recess R can be reduced.

Incidentally, in the state where second transfer bias V2 is equal to reference transfer bias Vt, the amount of the electric charge generated by secondary transfer bias W in one cycle of secondary transfer bias W is greater than the amount of the electric charge generated by the secondary transfer bias composed only of reference transfer bias Vt by the amount corresponding to first application period W1. That is, the total electric charge amount at portions other than recess R in sheet S1 in one cycle is large, and consequently reverse charging of toner T due to excessive current may possibly occur at the portions.

Figure 6:
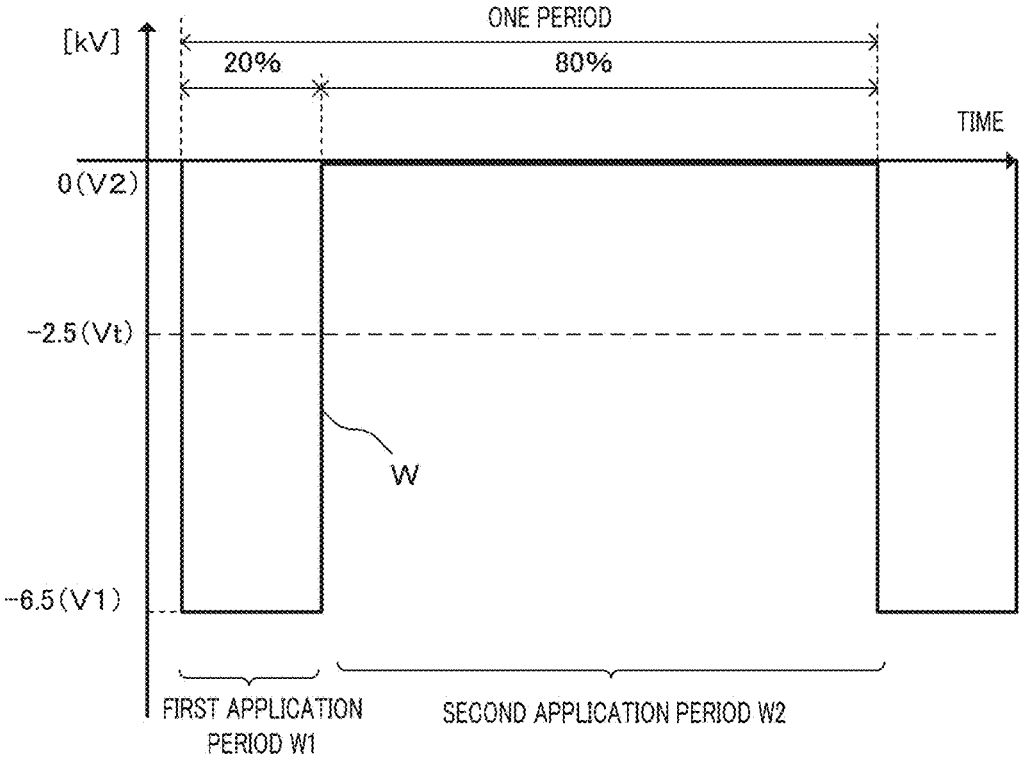
FIG. 6 shows a second example of the secondary transfer bias.

In view of this, in the present embodiment, voltage applying section 90 may set second transfer bias V2 to a value smaller than that of reference transfer bias Vt in absolute value as illustrated in FIG. 6.

In FIG. 6, first transfer bias V1 is set to −6.5 [kV], second transfer bias V2 to 0 [V], reference transfer bias Vt to −2.5 [kV], the duty ratio of the part corresponding to first application period W1 of secondary transfer bias W to 20[1%], and the frequency of secondary transfer bias W to 100 [Hz].

In this manner, the total amount of the electric charge generated by secondary transfer bias W in one cycle of secondary transfer bias W can be reduced, and thus reverse charging of toner T due to excessive current at portions other than recess R in sheet S1 can be suppressed.

In addition, desirably, voltage applying section 90 sets second transfer bias V2 such that the time integration value of the difference between reference transfer bias Vt and first transfer bias V1, and the time integration value of the difference between reference transfer bias Vt and second transfer bias V2 are equal to each other.

Figure 7:
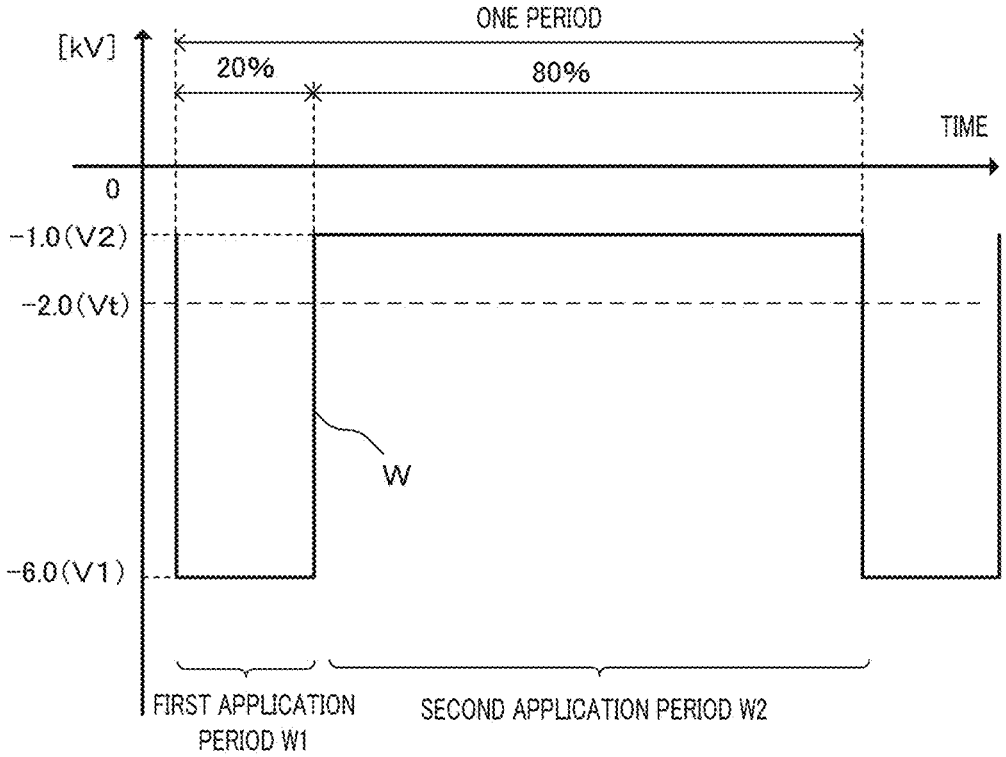
FIG. 7 shows a third example of the secondary transfer bias.

In FIG. 7, first transfer bias V1 is set to −6.0 [kV], second transfer bias V2 to −1.0 [kV], reference transfer bias Vt to −2.0 [kV], the duty ratio of the part corresponding to first application period W1 of secondary transfer bias W to 20[%], and the frequency of secondary transfer bias W to 200 [Hz].

In this manner, the amount of the electric charge generated by the secondary transfer bias composed only of reference transfer bias Vt and the amount of the electric charge generated by secondary transfer bias W in one cycle of secondary transfer bias W are equal to each other. Therefore, while maintaining the transfer ability at the secondary transfer nip to the transfer ability of the case where the secondary transfer bias composed only of reference transfer bias Vt is applied, electrostatic discharge D generated in the space of recess R of sheet S1 and reverse charging of toner T at portions other than recess R can be suppressed.

Incidentally, in the case of a secondary transfer bias composed of pulse waves having alternating current components in which a first voltage corresponding to the first application period and a second voltage corresponding to the second application period have different polarities, a first voltage for moving toner T to sheet S1 side, and a second voltage for moving toner T to intermediate transfer belt 421 side are alternately repeated. Therefore, when the frequency of the pulse wave is set to an excessively small value, the first application period and the second application period are expanded, and consequently, the portion corresponding to the first voltage and the portion corresponding to the second voltage are output to the image when image is output to sheet S1. As a result, an image having a striped pattern of density difference is formed.

In contrast, in the present embodiment, second transfer bias V2 is set to a voltage having the same polarity as that of first transfer bias V1, or a voltage of 0 [V], and therefore reciprocation of toner T between intermediate transfer belt 421 and sheet S1 is not caused unlike the case of the secondary transfer bias composed of pulse waves having alternating current components. Therefore, the frequency of secondary transfer bias W can be set to a small value. Accordingly in the present embodiment, voltage applying section 90 can be composed using a direct current power source.

When voltage applying section 90 is composed using a direct current power source, secondary transfer bias W identical to that illustrated in FIG. 7 can be output from voltage applying section 90 by switching the output in the first application period W1 every 2 [msec], and the output in the second application period W2 every 8 [msec] in the case where the frequency is set to 100 [Hz], for example.

When voltage applying section 90 is composed using a direct current power source in the above-mentioned manner, cost can be reduced in comparison with a configuration using an alternating current power source. It is to be noted that voltage applying section 90 can be composed using a direct current power source in the case where the frequency is equal to or lower than 400 [Hz].

In addition, in the present embodiment, since second transfer bias V2 is set to a voltage having the same polarity as that of first transfer bias V1 or a voltage of 0 [V], the potential difference between first transfer bias V1 and second transfer bias V2 is smaller than the potential difference between the first voltage and the second voltage of the secondary transfer bias composed of pulse waves having alternating current components.

Accordingly, it is possible to reduce noise generated at rising of secondary transfer bias W (hereinafter referred to as "overshooting"), noise generated at falling of secondary transfer bias W (hereinafter referred to as "undershooting"), and a situation in which intended voltage waveforms are not instantly formed due to the responsiveness of the power source (hereinafter referred to as "sagging") can be reduced. Therefore, it is possible to reduce high pressure abnormality due to overshooting and undershooting and reduction in effective voltage due to sagging.

Figure 8:
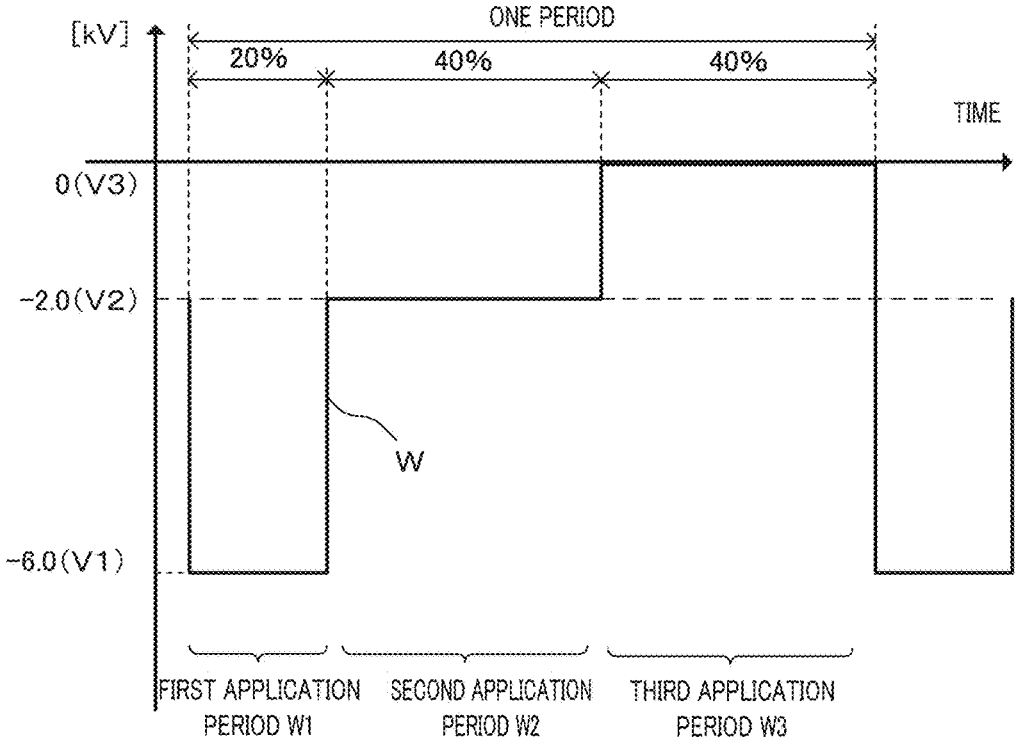
FIG. 8 shows a fourth example of the secondary transfer bias.

Voltage applying section 90 may output secondary transfer bias W including three output levels as illustrated in FIG. 8 for the purpose of further reducing the above-mentioned overshooting, undershooting and sagging. This secondary transfer bias W is composed of first application period W1 corresponding to first transfer bias V1, second application period W2 corresponding to second transfer bias V2, and third application period W3 corresponding to third transfer bias V3.

In FIG. 8, first transfer bias V1 is set to −6.0 [kV], second transfer bias V2 to −2.0 [kV], third transfer bias V3 to 0 [V], reference transfer bias Vt to −2.0 [kV], the duty ratio of the part corresponding to first application period W1 of secondary transfer bias W to 20[%], the duty ratio of the part corresponding to second application period W2 of secondary transfer bias W to 40[%], and the duty ratio of the part corresponding to third application period W3 of secondary transfer bias W to 40[%].

With this configuration, by providing second transfer bias V2 between first transfer bias V1 and third transfer bias V3, the change width of the voltage in secondary transfer bias W can be reduced. Therefore, overshooting, undershooting and sagging can be further reduced.

Figure 9:
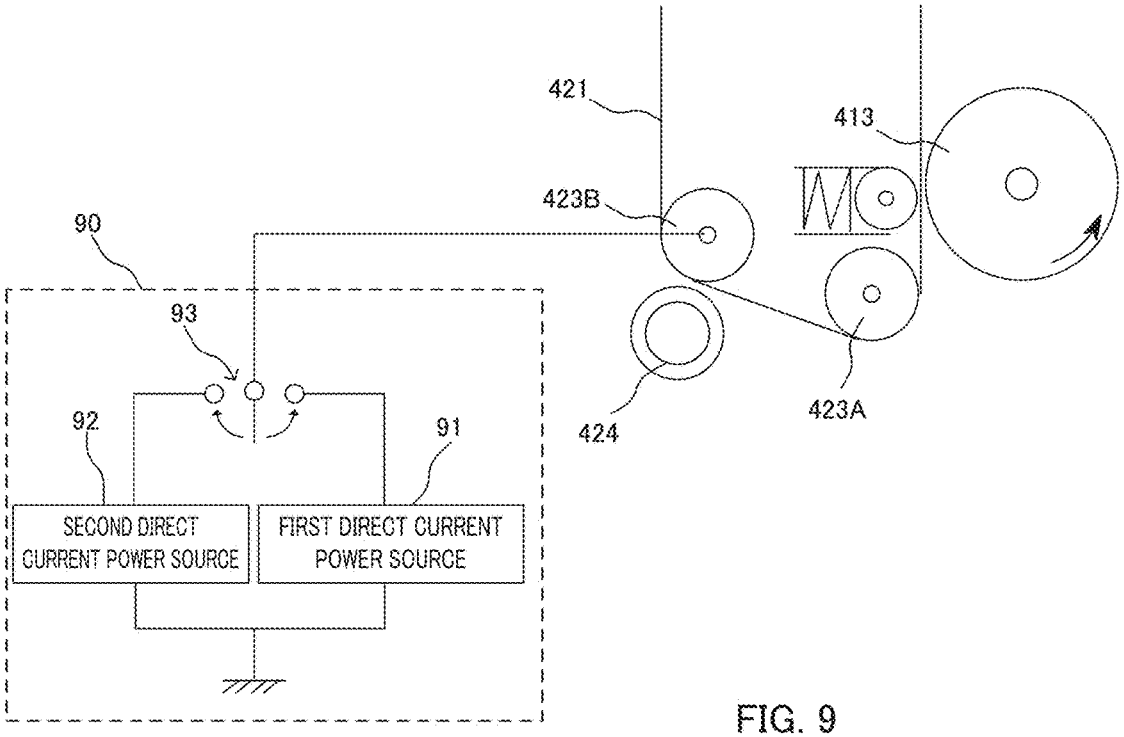
FIG. 9 illustrates a region around a voltage applying section and a secondary transfer nip of an intermediate transfer unit according to a modification.

In addition, as illustrated in FIG. 9, voltage applying section 90 may be composed of a plurality of direct current power sources. In this configuration, voltage applying section 90 includes first direct current power source 91, second direct current power source 92, and switch 93 connected with backup roller 423B. Switch 93 can selectively connect first direct current power source 91 and second direct current power source 92.

Figure 10:
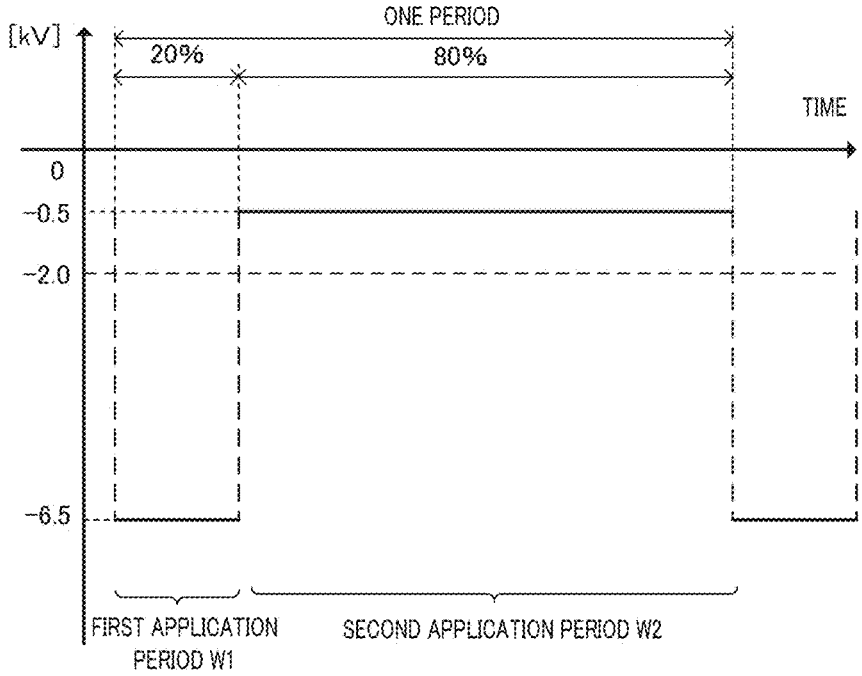
FIG. 10 shows an example of a secondary transfer bias according to a modification.

In this configuration, as illustrated in FIG. 10, the frequency is set to 100 [Hz], the duty ratio of the part corresponding to first application period W1 of secondary transfer bias W to 20[%], first direct current power source 91 to −6.5 [kV], second direct current power source 92 to −0.5 [kV], and reference transfer bias Vt to −2.0 [kV], for example. In this case, secondary transfer bias W identical to that of the case of pulse waves can be output by connecting switch 93 to second direct current power source 91 for 8 [msec] after connecting switch 93 to first direct current power source 92 for 2 [msec].

With this configuration, since the output voltage is not varied in one power source, noise due to switching between the output levels, that is, overshooting and undershooting, can be prevented.

While secondary transfer bias W includes one first application period W1 and one second application period W2 in one cycle in the above-mentioned embodiment, the present invention is not limited to this, and secondary transfer bias W may include a plurality of first application periods W1 and second application periods W2. Desirably, secondary transfer bias W includes eight or ten first application periods W1 and second application periods W2.

In addition, voltage applying section 90 may have a configuration for selectively changing the output in accordance with the type of the sheet.

In addition, while an intermediate transfer type is adopted in the above-mentioned embodiment, a direct transferring type may also be adopted. In addition, while the transfer member is backup roller 423B in the above-mentioned embodiment, the transfer member may be secondary transfer roller 424. In addition, while the secondary transfer bias is a negative voltage in the above-mentioned embodiment, a positive voltage may also be used in the case where positive toner is used for example.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

Finally, an experiment for an evaluation of image forming apparatus 1 according to the present embodiment is described.

In this experiment, a solid image was formed on sheet S1 under a condition of temperature of 23[° C.] and humidity of 50[%] so as to evaluate transfer in recess R of sheet S1 in accordance with first transfer bias V1, the frequency of secondary transfer bias W and the duty ratio of the part corresponding to first application period W1 of secondary transfer bias W.

Figure 11:
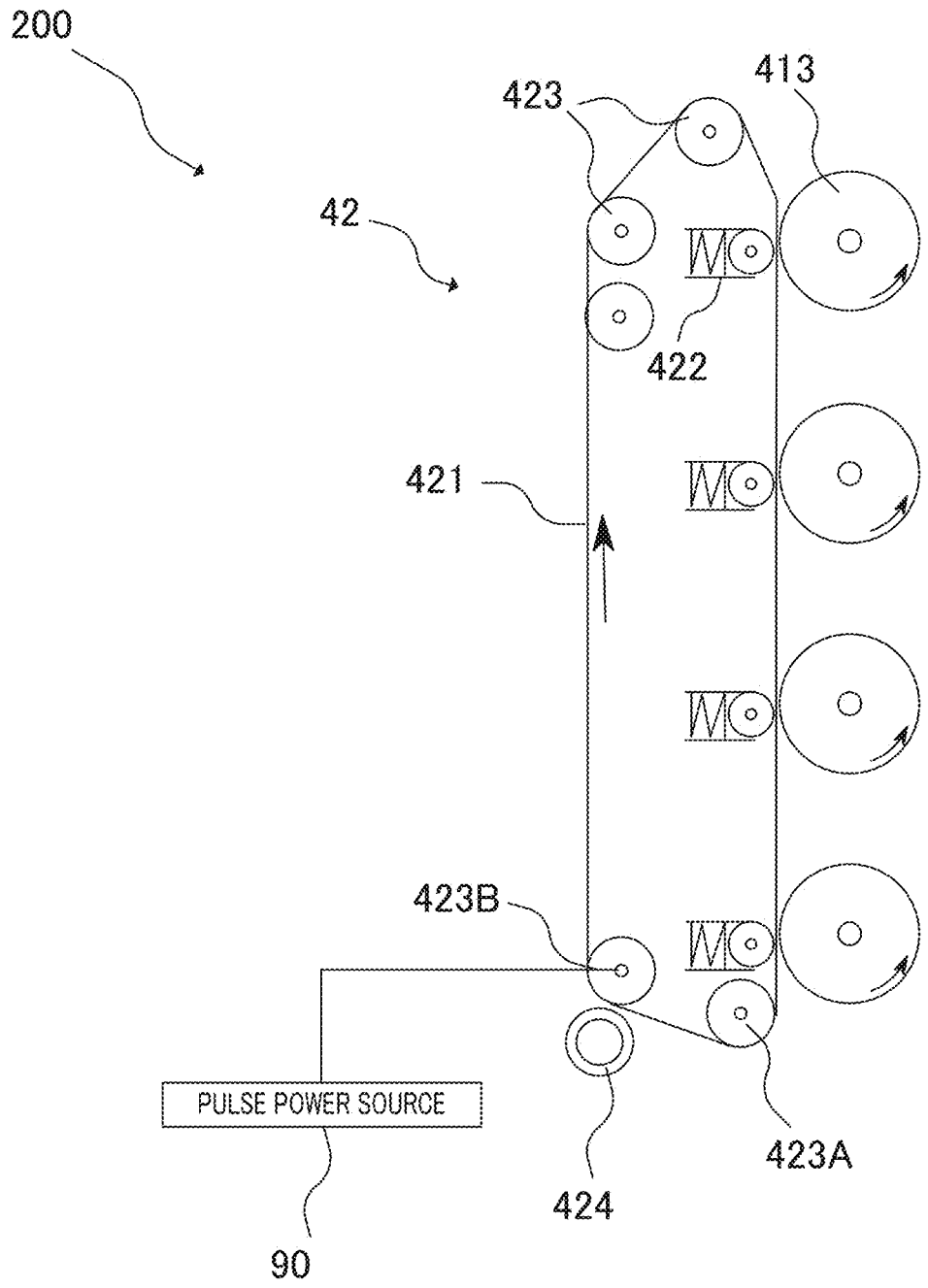
FIG. 11 illustrates an evaluation apparatus of an evaluation experiment.

For the evaluation, transfer device 200 illustrated in FIG. 11 was used. Transfer device 200 includes voltage applying section 90 composed of a pulse power source and intermediate transfer unit 42 as in image forming apparatus 1 illustrated in FIG. 1.

As intermediate transfer belt 421, a semiconductor belt made of polyimide having a thickness of 80 [μm], and a resistance of 11.0 [Log Ω/□] was used. As secondary transfer roller 424, a roller composed of nitrile rubber (NBR) of a straight shape having a diameter of 38 [mm], an AskerC hardness of 71°, and a resistance of 7.5 [Log Ω] was used. As backup roller 423B, a roller composed of a nitrile rubber of a straight shape having a diameter of 38 [mm], an AskerC hardness of 71°, and a resistance of 7.5 [Log Ω] was used.

In addition, the pressure force of secondary transfer roller 424 against backup roller 423B was 80[N], the system speed was 200 [mm/sec], the width of the secondary transfer nip was 4 [mm], and the nip time was 0.02 [sec].

In addition, as sheet S1, LEATHAC 66 of white having a basis weight of 151 [gsm] was used. In the above-mentioned condition, −2.0 [kV] is the optimum value of the voltage value of the reference transfer bias Vt, and the evaluation was made with second transfer bias V2 set to −2.0 [kV]. The optimum value of reference transfer bias Vt is determined by, but not limited to, environment detection and the like, or active transfer voltage conrol (ATVC). The optimum value may be appropriately determined.

Table 1 shows the evaluation on transfer in recess R of sheet S1 in the case where the frequency of the secondary transfer bias was set to 100 [Hz]. Table 2 shows the evaluation on transfer in recess R of sheet S1 in the case where the frequency of the secondary transfer bias was set to 500 [Hz]. Table 3 shows the evaluation on transfer in recess R of sheet S1 in the case where the frequency of the secondary transfer bias was set to 700 [Hz]. Table 4 shows the evaluation on transfer in recess R of sheet S1 in the case where the frequency of the secondary transfer bias was set to 1,000 [Hz].

TABLE 1

| | | Duty ratio of the part corresponding to the first application period of the secondary transfer bias [%] | | | | |
|---|---|---|---|---|---|---|
| | | 10 | 20 | 30 | 40 | 50 |
| 1st transfer bias [kV] | −2 | poor | poor | poor | poor | poor |
| | −2.5 | poor | poor | poor | poor | poor |
| | −3 | poor | poor | fair | fair | fair |
| | −3.5 | poor | poor | fair | fair | fair |
| | −4 | poor | good | good | good | good |
| | −4.5 | fair | good | good | good | poor* |
| | −5 | good | good | good | poor* | poor* |
| | −5.5 | good | good | good | poor* | poor* |
| | −6 | good | good | poor* | poor* | poor* |
| | −6.5 | good | good | poor* | poor* | poor* |
| | −7 | good | poor* | poor* | poor* | poor* |
| | −7.5 | fair | poor* | poor* | poor* | poor* |
| | −8 | poor* | poor* | poor* | poor* | poor* |

TABLE 2

| | | Duty ratio of the part corresponding to the first application period of the secondary transfer bias [%] | | | | |
|---|---|---|---|---|---|---|
| | | 10 | 20 | 30 | 40 | 50 |
| 1st transfer bias [kV] | −2 | poor | poor | poor | poor | poor |
| | −2.5 | poor | poor | poor | poor | poor |
| | −3 | poor | poor | fair | fair | fair |
| | −3.5 | poor | poor | fair | fair | fair |
| | −4 | poor | good | good | good | good |
| | −4.5 | fair | good | good | good | poor* |
| | −5 | good | good | good | poor* | poor* |
| | −5.5 | good | good | good | poor* | poor* |
| | −6 | good | good | good | poor* | poor* |
| | −6.5 | good | good | poor* | poor* | poor* |
| | −7 | good | good | poor* | poor* | poor* |
| | −7.5 | good | good | poor* | poor* | poor* |
| | −8 | poor* | poor* | poor* | poor* | poor* |

TABLE 3

| | | Duty ratio of the part corresponding to the first application period of the secondary transfer bias [%] | | | | |
|---|---|---|---|---|---|---|
| | | 10 | 20 | 30 | 40 | 50 |
| 1st transfer bias [kV] | −2 | poor | poor | poor | poor | poor |
| | −2.5 | poor | poor | poor | poor | poor |
| | −3 | poor | poor | fair | fair | fair |
| | −3.5 | poor | poor | fair | fair | fair |
| | −4 | poor | good | good | good | good |
| | −4.5 | fair | good | good | good | poor* |
| | −5 | good | good | good | poor* | poor* |
| | −5.5 | good | good | good | poor* | poor* |
| | −6 | good | good | good | poor* | poor* |
| | −6.5 | good | good | good | poor* | poor* |
| | −7 | good | good | poor* | poor* | poor* |
| | −7.5 | good | good | poor* | poor* | poor* |
| | −8 | good | poor* | poor* | poor* | poor* |

TABLE 4

| | | Duty ratio of the part corresponding to the first application period of the secondary transfer bias [%] | | | | |
|---|---|---|---|---|---|---|
| | | 10 | 20 | 30 | 40 | 50 |
| 1st transfer bias [kV] | −2 | poor | poor | poor | poor | poor |
| | −2.5 | poor | poor | poor | poor | poor |
| | −3 | poor | poor | fair | fair | fair |
| | −3.5 | poor | poor | fair | fair | fair |
| | −4 | poor | good | good | good | poor* |
| | −4.5 | fair | good | good | poor* | poor* |
| | −5 | good | good | good | poor* | poor* |
| | −5.5 | good | good | good | poor* | poor* |
| | −6 | good | good | good | poor* | poor* |
| | −6.5 | good | good | good | poor* | poor* |
| | −7 | good | good | poor* | poor* | poor* |
| | −7.5 | good | good | poor* | poor* | poor* |
| | −8 | good | poor* | poor* | poor* | poor* |

In the evaluation in each table, "good" indicates that no transfer defect was caused and favorable transfer was achieved, "fair" indicates that no practical problem was caused although transfer defect was partially found, and "poor" indicates that transfer defect, electrostatic discharge in the recess, and reverse charging of toner at portions other than the recess were found.

It was confirmed from the above-mentioned results that, while it depends on the duty ratio of the part corresponding to the first application period of the secondary transfer bias, favorable transfer is achieved when first transfer bias V1 is equal to or smaller than −3.0 [kV] which is 1.5 time the reference transfer bias Vt, and desirably, when first transfer bias V1 is equal to or smaller than −4.0 [kV] which is double the reference transfer bias Vt.

In addition, in each table, at parts "poor" with an asterisk, electrostatic discharge in the recess and reverse charging of toner at the portions other than the recess were found. It can be confirmed that such regions where electrostatic discharge and reverse charging of toner are caused tend to be reduced as the frequency is increased in the case where the duty ratio of the part corresponding to the first application period of the secondary transfer bias is equal to or lower than 30[%]. One reason for this that the time of the first application period is reduced as the frequency is increased.

On the other hand, it was confirmed that, when the duty ratio of the part corresponding to the first application period of the secondary transfer bias is higher than 40[%], the number of "poor" with an asterisk is substantially the same among the frequencies. It can be said that, in this part, electrostatic discharge tends to be easily generated due to the increased first application period along with increase of the duty ratio of the part corresponding to the first application period of the secondary transfer bias.

In addition, in each table, even when the frequency is changed in the parts of "poor" without an asterisk, substantially no difference was found. One reason for this is that the electric field enough to move toner to sheet S1 is not generated in recess R of sheet S1 since the potential difference between reference transfer bias Vt and first transfer bias V1 is small.

Next, an experiment was conducted under the same conditions as the above-mentioned experiment except that a plurality of first application periods W1 and second application periods W2 are provided in secondary transfer bias W. To be more specific, the numbers of first application period W1 and second application period W2 are set for each frequency of secondary transfer bias W, and transfer in recess R of sheet S1 was evaluated.

Table 5 shows the evaluation on transfer in recess R of sheet S1 in the case where the duty ratio of the part corresponding to the first application period of the secondary transfer bias was set to 10[%]. Table 6 shows the evaluation on transfer in recess R of sheet S1 in the case where the duty ratio of the part corresponding to the first application period of the secondary transfer bias was set to 20[%].

TABLE 5

| | | Frequency [Hz] | | | | | |
|---|---|---|---|---|---|---|---|
| | | 50 | 100 | 200 | 300 | 400 | 500 |
| 1st transfer bias [kV] | −2 | poor | poor | poor | poor | poor | poor |
| | −2.5 | poor | poor | poor | poor | poor | poor |
| | −3 | poor | poor | poor | poor | poor | poor |
| | −3.5 | poor | poor | poor | poor | poor | poor |
| | −4 | poor | poor | poor | poor | poor | poor |
| | −4.5 | fair | fair | fair | fair | fair | fair |
| | −5 | good | good | good | good | good | good |
| | −5.5 | good | good | good | good | good | good |
| | −6 | good | good | good | good | good | good |
| | −6.5 | fair | good | good | good | good | good |
| | −7 | fair | good | good | good | good | good |
| | −7.5 | fair | fair | good | good | good | good |
| | −8 | poor | poor | poor | poor | fair | fair |
| Number of application periods | | 1 | 2 | 4 | 6 | 8 | 10 |

TABLE 6

| | | Frequency [Hz] | | | | | |
|---|---|---|---|---|---|---|---|
| | | 50 | 100 | 200 | 300 | 400 | 500 |
| 1st transfer bias [kV] | −2 | poor | poor | poor | poor | poor | poor |
| | −2.5 | poor | poor | poor | poor | poor | poor |
| | −3 | poor | poor | poor | poor | poor | poor |
| | −3.5 | poor | poor | poor | poor | poor | poor |
| | −4 | poor | good | good | good | good | good |
| | −4.5 | fair | good | good | good | good | good |
| | −5 | fair | good | good | good | good | good |
| | −5.5 | good | good | good | good | good | good |
| | −6 | fair | good | good | good | good | good |
| | −6.5 | fair | good | good | good | good | good |
| | −7 | poor | fair | good | good | good | good |
| | −7.5 | poor | fair | good | good | good | good |
| | −8 | poor | poor | poor | poor | fair | fair |
| Number of application periods | | 1 | 2 | 4 | 6 | 8 | 10 |

It is to be noted that the number of application periods indicates the number of the application periods while a sheet passes through the secondary transfer nip.

It was confirmed from the results of each table that the evaluation on the case of first transfer bias V1 set to −8 [kV] was improved when eight or ten first application periods W1 and second application periods W2 were provided.

In addition, while the lower limit value of the frequency varies depending on the configuration of the image forming apparatus, it suffices to set the lower limit value of the frequency such that at least one first application period and one second application period are provided in the secondary transfer nip.

In addition, while the above-mentioned experiment was conducted with the parameters having the above-mentioned relationship, the parameters vary depending on the configuration of the image forming apparatus such as the system speed and the configuration of the transfer nip, the environment condition, the type of the sheet, the output image and the like, and therefore the present invention is not limited to the above-mentioned relationship. The parameters may be set in accordance with the circumstances based on the above-mentioned experiment.

In addition, in the case where the time of the transfer nip is short due to increase in system speed, reduction in width of the transfer nip and the like, and in the case where the depth of recess R of sheet S1 is increased, it is preferable to adjust the parameters so as to quantitatively increase each parameter.

What is claimed is:

1. A transfer device comprising:

an image bearing member on which to bear a toner image;

a transfer member used for forming a transfer nip at the image bearing member;

a power source configured to apply to the transfer member a transfer bias of one polarity for transferring a toner image on the image bearing member to a sheet passing through the transfer nip; and a controller configured to control the power source to apply the transfer bias to the transfer member when a first sheet having a small surface smoothness passes through the transfer nip, the transfer bias including a first application period for applying a first transfer bias greater than a reference transfer bias in absolute value and a second application period for applying a second transfer bias equal to or smaller than the reference transfer bias in absolute value, the first application period and the second application period being alternately provided, wherein the controller is further configured to control the power source to apply the transfer bias to the transfer member when a second sheet passes through the transfer nip, the transfer bias is equal to the reference transfer bias when all portions of the second sheet passes through the transfer nip, and the second sheet having a surface smoothness greater than that of the first sheet.

2. The transfer device according to claim 1, wherein a period during which all positions on the first sheet pass through the transfer nip includes the first application period and the second application period.

3. The transfer device according to claim 1, wherein the second transfer bias is smaller than the reference transfer bias in absolute value.

4. The transfer device according to claim 3, wherein a time integration value over the first application period of a difference between the reference transfer bias and the first transfer bias is equal to a time integration value over the second application period of a difference between the reference transfer bias and the second transfer bias.

5. The transfer device according to claim 1, wherein the power source includes a direct current power source configured to apply and switch the first transfer bias and the second transfer bias.

6. The transfer device according to claim 5, wherein the direct current power source includes:

a first direct current power source configured to apply the first transfer bias; and a second direct current power source configured to apply the second transfer bias.

7. The transfer device according to claim 1, wherein, in the transfer bias, the number of the first application periods and the second application periods is eight or ten.

8. An image forming apparatus comprising:

an image bearing member on which to bear a toner image;

a transfer member used for forming a transfer nip at the image bearing member;

a power source configured to apply to the transfer member a transfer bias of one polarity for transferring a toner image on the image bearing member to a sheet passing through the transfer nip; and a controller configured to control the power source to apply the transfer bias to the transfer member when a first sheet having a small surface smoothness passes through the transfer nip, the transfer bias including a first application period for applying a first transfer bias greater than a reference transfer bias in absolute value and a second application period for applying a second transfer bias equal to or smaller than the reference transfer bias in absolute value, the first application period and the second application period being alternately provided, wherein the controller is further configured to control the power source to apply the transfer bias to the transfer member when a second sheet passes through the transfer nip, the transfer bias is equal to the reference transfer bias when all portions of the second sheet passes through the transfer nip, and the second sheet having a surface smoothness greater than that of the first sheet.

9. The image forming apparatus according to claim 8, wherein a period during which all positions on the first sheet pass through the transfer nip includes the first application period and the second application period.

10. The image forming apparatus according to claim 8, wherein the second transfer bias is smaller than the reference transfer bias in absolute value.

11. The image forming apparatus according to claim 10, wherein a time integration value over the first application period of a difference between the reference transfer bias and the first transfer bias is equal to a time integration value over the second application period of a difference between the reference transfer bias and the second transfer bias.

12. The image forming apparatus according to claim 8, wherein the power source includes a direct current power source configured to apply and switch the first transfer bias and the second transfer bias.

13. The image forming apparatus according to claim 12, wherein the direct current power source includes:

a first direct current power source configured to apply the first transfer bias; and a second direct current power source configured to apply the second transfer bias.

14. The image forming apparatus according to claim 8, wherein, in the transfer bias, the number of the first application periods and the second application periods is eight or ten.

15. A computer-readable recording medium storing a program of a transfer device, the transfer device comprising:

an image bearing member on which to bear a toner image;

a transfer member used for forming a transfer nip at the image bearing member; and a power source configured to apply to the transfer member a transfer bias of one polarity for transferring a toner image on the image bearing member to a sheet passing through the transfer nip, wherein the program causes a computer of the transfer device to execute a process of controlling the power source to apply the transfer bias to the transfer member when a first sheet having a small surface smoothness passes through the transfer nip, the transfer bias including a first application period for applying a first transfer bias greater than a reference transfer bias in absolute value and a second application period for applying a second transfer bias equal to or smaller than the reference transfer bias in absolute value, the first application period and the second application period being alternately provided, wherein the process of controlling the power source causes the power source to apply the transfer bias to the transfer member when a second sheet passes through the transfer nip, the transfer bias is equal to the reference transfer bias when all portions of the second sheet passes through the transfer nip, and the second sheet having a surface smoothness greater than that of the first sheet.

16. The recording medium according to claim 15, wherein a period during which all positions on the first sheet pass through the transfer nip includes the first application period and the second application period.

17. The recording medium according to claim 15, wherein the second transfer bias is smaller than the reference transfer bias in absolute value.

18. The recording medium according to claim 17, wherein a time integration value over the first application period of a difference between the reference transfer bias and the first transfer bias is equal to a time integration value over the second application period of a difference between the reference transfer bias and the second transfer bias.

19. The recording medium according to claim 15, wherein the power source includes a direct current power source configured to apply and switch the first transfer bias and the second transfer bias.

20. The recording medium according to claim 19, wherein the direct current power source includes:

a first direct current power source configured to apply the first transfer bias; and a second direct current power source configured to apply the second transfer bias.

* * * * *